US006484764B1

(12) United States Patent
Wegman et al.

(10) Patent No.: US 6,484,764 B1
(45) Date of Patent: Nov. 26, 2002

(54) FILLING APPARATUS HAVING AN EVEN-FILLING NOZZLE

(75) Inventors: Paul M. Wegman, Pittsford, NY (US); Lee J. Gang, Jr., Rochester, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/021,031

(22) Filed: Dec. 19, 2001

(51) Int. Cl.[7] ..... B65B 1/04
(52) U.S. Cl. ..... 141/286; 141/67; 141/256
(58) Field of Search ..... 141/67, 65, 2, 141/18, 59, 256, 286; 239/601, 597, 598, 599, 509, 521

(56) References Cited

U.S. PATENT DOCUMENTS 4,492,294 A * 1/1985 Ball ..... 141/93
5,226,863 A * 7/1993 Kimura ..... 141/8
5,950,868 A * 9/1999 Wegman ..... 141/256

* cited by examiner

*Primary Examiner*—Steven O. Douglas
(74) *Attorney, Agent, or Firm*—Tallam I. Nguti

(57) ABSTRACT

An apparatus is provided for directing toner from a hopper containing a supply of toner to evenly fill a non-symmetric container without excessive dusting and spills. The apparatus includes (a) a conduit member operably connected to the hopper and having a discharging end for permitting a toner to be moved therethrough; (b) a conveyor device located at least partially within the conduit member for moving the toner from the hopper in a toner moving direction towards the non-symmetric container; and (c) a nozzle member for directing the toner from the conveyor to evenly fill the non-symmetric container. The nozzle member is operably connected to the discharge end of the conduit member and has a first end connected to the conduit member, a second and opposite end for dispensing moving toner into the non-symmetric container, and a central portion between the first end and the second and opposite end. The second and opposite end includes an enclosed toner redirecting structure for changing the toner moving direction so as to enable even-filling of the non-symmetric container without excessive dusting and spills.

7 Claims, 4 Drawing Sheets

FILLING APPARATUS HAVING AN EVEN-FILLING NOZZLE

RELATED APPLICATIONS

This application is related to U.S. application Ser. No. 10/021,033 entitled "Filling Apparatus Having a Clean-shutoff Conveyor" filed on the same date herewith, and having at least one common inventor.

BACKGROUND OF THE INVENTION

This invention relates generally to apparatus for filling a container with dry particulate material, and more particularly concerns a filling apparatus having an even-filling shaped nozzle for achieving even filling of a container with particulate materials such as toner.

Currently when filling particulate materials, for example toners into toner containers, toner is transported from the toner supply hopper into the container by a rotating auger. The auger is a spiral shaped mechanical part which pushes particles of toner inside a fill tube by direct mechanical contact. The nature of this mechanical contact process creates substantial limitations on accuracy and productivity of the toner filling operation. The speed of the toner movement in the fill tube is proportional to the speed of rotation of the auger and is limited by heat release due to auger/toner/funnel friction.

Toner containers for small low cost printers and copiers typically have a small opening into which the toner is to be added. Furthermore, the toner containers often have irregular shapes to conform to the allotted space within the copying machine. Therefore it becomes difficult to fill the toner container because of the small tube required to fit into the small toner container opening and secondly for all the toner within the container to completely and evenly fill the remote portions of the container before the container overflows.

Some of the problems associated with controlling the filling of such toner containers are due primarily to the properties of the toner. Toner is the image-forming material in a developer which when deposited by the field of an electrostatic charge becomes the visible record. There are two different types of developing systems known as one-component and two-component systems.

In one-component developing systems, the developer material is toner made of particles of magnetic material, usually iron, embedded in a black plastic resin. The iron enables the toner to be magnetically charged. In two-component systems, the developer material is comprised of toner which consists of small polymer or resin particles and a color agent, and carrier which consists of roughly spherical particles or beads usually made of steel. An electrostatic charge between the toner and the carrier bead causes the toner to cling to the carrier in the development process. Control of the flow of these small, abrasive and easily charged particles is very difficult.

The one-component and two-component systems utilize toner that is very difficult to flow. This is particularly true of the toner used in two component systems, but also for toner for single component systems. The toner tends to cake and bridge within the hopper. This limits the flow of toner through the small tubes which are required for addition of the toner through the opening of the toner container. Also, this tendency to cake and bridge may cause air gaps to form in the container resulting in partial filling of the container.

Attempts to improve the flow of toner have also included the use of an external vibrating device to loosen the toner within the hopper. These vibrators are energy intensive, costly and not entirely effective and consistent. Furthermore, they tend to cause the toner to causing dirt to accumulate around the filling operation.

Other attempts made to effectively fill such toner containers have included use of adapters positioned on the end of the toner filling auger which has an inlet corresponding to the size of the auger and an outlet corresponding to the opening in the toner container. Clogging of the toner, particularly when attempting to increase toner flow rates and when utilizing toners with smaller particle size, for example, color toners having a particle size of 7 microns or less, has been found to be a perplexing problem. The adapters that are fitted to the augers, thus, tend to clog with toner. The flow rates through such adapters is unacceptably low.

SUMMARY OF THE INVENTION

In accordance with the present invention, there is provided an apparatus for directing toner from a hopper containing a supply of toner to evenly fill a non-symmetric container without excessive dusting and spills. The apparatus includes (a) a conduit member operably connected to the hopper and having a discharging end for permitting a toner to be moved therethrough; (b) a conveyor device located at least partially within the conduit member for moving the toner from the hopper in a toner moving direction towards the non-symmetric container; and (c) a nozzle member for directing the toner from the conveyor to evenly fill the non-symmetric container. The nozzle member is operably connected to the discharge end of the conduit member and has a first end connected to the conduit member, a second and opposite end for dispensing moving toner into the non-symmetric container, and a central portion between the first end and the second and opposite end. The second and opposite end includes an enclosed toner redirecting structure for changing the toner moving direction so as to enable even-filling of the non-symmetric container without excessive dusting and spills.

BRIEF DESCRIPTION OF THE DRAWINGS

In the detailed description of the invention presented below, reference is made to the drawings in which.

DETAILED DESCRIPTION OF THE INVENTION

Figure 1:
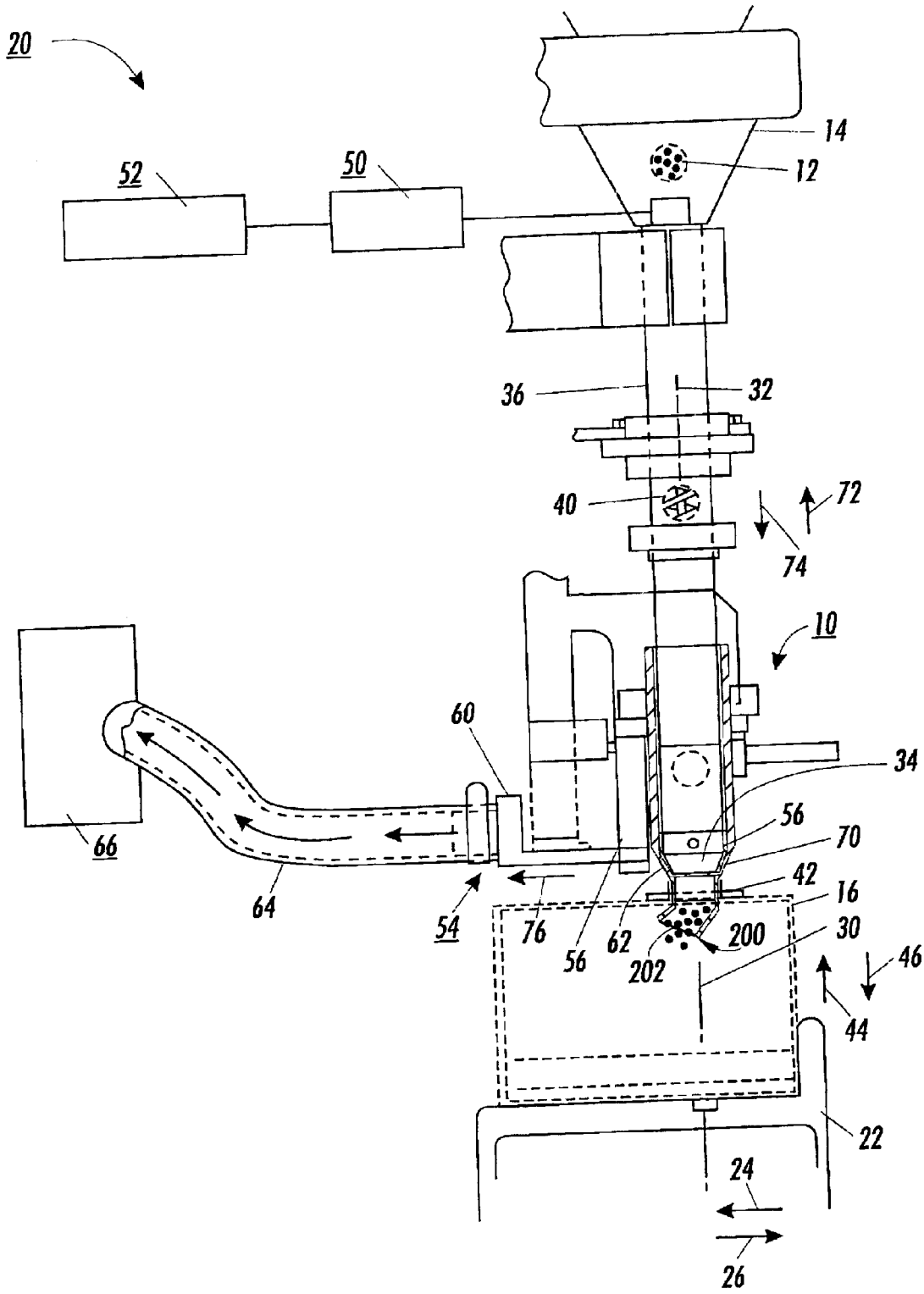
FIG. 1 is an elevational view of a container filling system partially in section utilizing the even-filling shaped nozzle of the present invention.

According to the present invention and referring now to FIG. 1, powder filling assisting apparatus 10 is shown. The powder filling assisting apparatus 10 is used to convey powder 12 in the form of toner for use in a copier or printer from a hopper 14 to a container 16. The powder filling apparatus 10 is mounted to filling line 20 to permit for the filling of large production quantities of containers 16, the container 16 is mounted to a carrying device 22. The device 22 is movable in the direction of either arrow 24 or 26. The carrying device 22 serves to position container centerline 30 in alignment with apparatus centerline 32.

The powder filling assisting apparatus 10 includes an even-filling nozzle 34 (in accordance with the present invention, and to be described in detail below) which is used to direct the powder 12 into the container 16. The even-filling nozzle 34 is connected to the hopper 14 by means of a conduit 36 in the form of a hollow tube or funnel.

As shown in FIG. 1, the hopper 14 is positioned above the container 16 whereby gravity will assist in the flow of powder 12 toward the container 16. To optimize the flow of powder 12 toward the container 16, the powder filling apparatus 10 further includes a conveyor 40 positioned at least partially within the conduit 36 for assisting in the flow of the powder 12. The conveyor 40 is in the form of a spiral conveyor or auger. For example, the auger 40 may be in the form of a spiral shaped auger, which may include various geometries, such as, a straight or tapered helical screw. The auger closely conforms to the conduit.

The even-filling nozzle 34 is insertable into opening 42 of the container 16. The insertion of the even-filling nozzle 34 in the opening 42 may be accomplished in any suitable method. For example, the carrying device 22 and, consequently, the container 16 may be movable upward in the direction of arrow 44 for engagement with the even-filling nozzle 34 and downward in the direction of arrow 46 for disengagement from the opening 42. The upward and downward motion of the device 22 and the container 16 permits the container 16 to be indexed in the direction of arrows 24 and 26.

To permit the filling of a number of containers 16, the flow of powder 12 from the hopper 14 must be halted during the indexing of a filled container 16 from the fill position and during the indexing of the unfilled container 16 toward the filling position. As shown in FIG. 1, the flow of powder 12 may be halted by the stopping of auger 40 within the conduit 36. The auger 40 may be rotated by any suitable method, i.e. by motor 50 operably connected to the auger 40. The motor 50 is connected to a controller 52 which sends a signal to the motor 50 to stop the rotation of the auger 40 during indexing of the carrying device 22. It should be appreciated, however, that the flow of powder 12 through the conduit 36 may be further controlled by the use of a valve therein (not shown).

Provisions are made to assure that the filling line 20 is free from airborne powder 12 which may escape between the even-filling nozzle 34 and the opening 42 of the container 16 during the filling operation and in particular during the indexing of the carrying device for presenting an unfilled container 16 to the powder filling apparatus 10. A clean filling system 54 is shown in FIG. 1 for use with the apparatus 10. The clean filling system is secured to filling line 20 as well as to the conduit 36, and may be used to support slide 60. Slide 60 is connected to a tray or toner drip plate (not labeled) which slidably is fitted between the even-filling nozzle 34 and the opening 42. The tray or drip plate in this position acts to prevent the spilling of powder 12 during the indexing of the containers 16. A housing 56 which surrounds part of the even-filling nozzle 34, provides a cavity or chamber 62 which is sealed when the tray or drip plate is in its closed position. The chamber 62 is kept under vacuum via a toner dust vacuum line 64 to a vacuum source 66.

Figure 2:
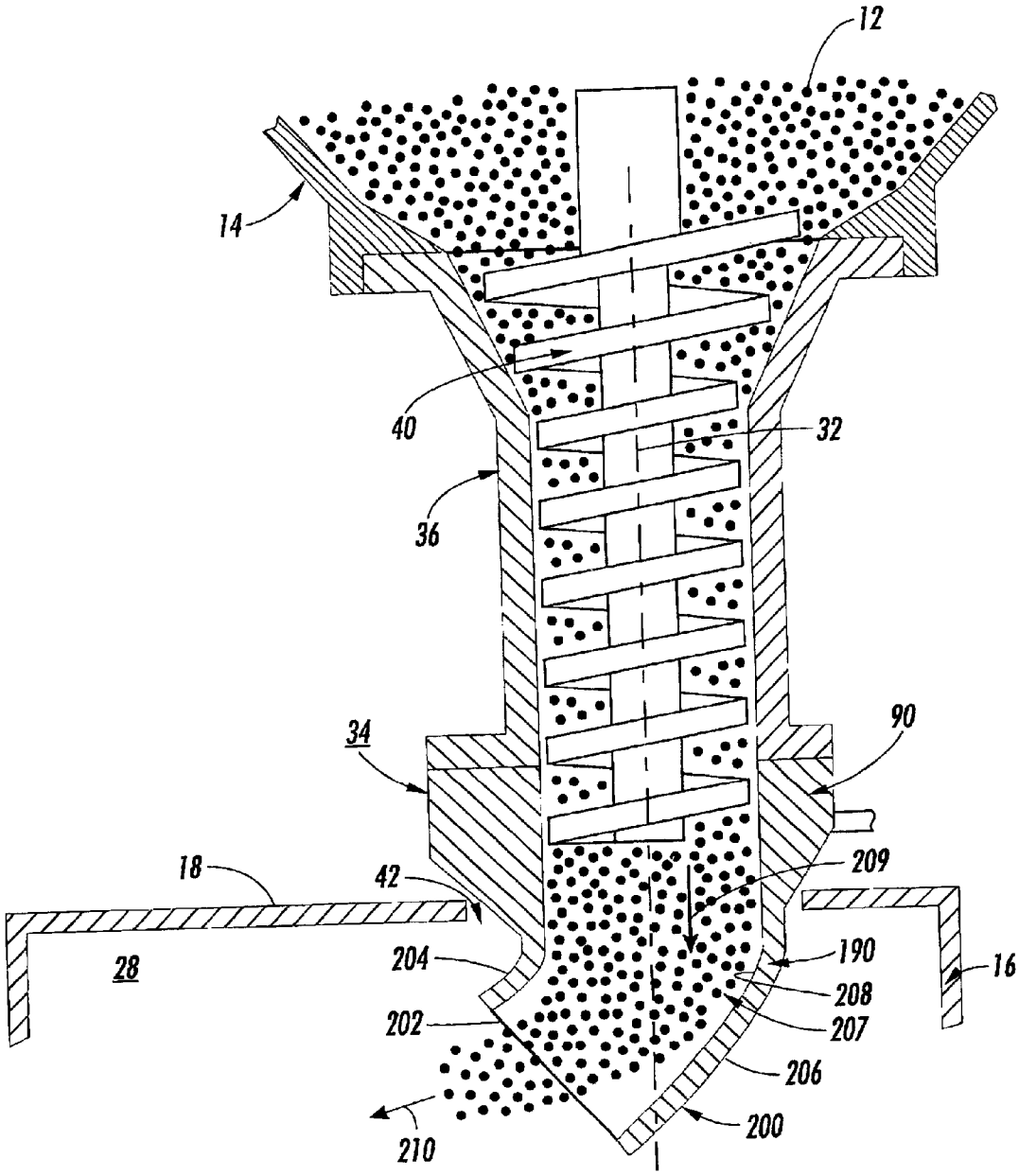
FIG. 2 is an elevational view of a first example of a container having a non-centrally located opening and thus requiring use of a first embodiment of the even-filling shaped nozzle of the present invention.

Referring now to FIGS. 1–2, a first embodiment of the even-filling nozzle 34 is shown and includes a first end 90 adjacent the conduit 36 as well as a second end 200 opposed to the first end 90. The even-filling nozzle 34 is secured to the conduit 36 in any suitable fashion. For example, as shown the first end 90 of the even-filling nozzle 34 may be press fitted over the conduit 36. Between the first end 90 and the second end 200 of the even-filling nozzle 34 is a central portion 190 of the nozzle. The central portion 190 has a hollow substantially conofrustrical shape or funnel like shape.

The even-filling nozzle 34 is an asymmetric low friction compression nozzle that has a non-straight shape which is adapted for even, efficient direct filling of a toner a non-symmetric container. As shown in FIGS. 1–4, a non-symmetric container 16 is one where the opening 42 into a top 18 is not located centrally relative to the width and depth of the top 18, and the volume 28 to be filled. As such, the container is deeper (to the left as shown and for example) than it is to the right. The even-filling nozzle 34 is nozzle thus still provides all the features of a straight nozzle as well as the advantageous ability of more evenly filling of such a container.

As shown in FIG. 2, the second or discharge end 200 includes a discharge opening 202 defined by a wall having a first side 204 and a second and opposite side 206. The second and opposite end 200 includes an enclosed powder redirecting means 207, shown as an angular bend 208 for changing the powder moving direction from 209 to 210, so as to enable even-filling of the non-symmetric container 16 without excessive dusting and spills. In a first embodiment (FIGS. 1 and 2), and in a second embodiment (FIGS. 3 and 4), the enclosed powder redirecting means 207 comprises the angular bend 208 within the central portion 190. In the first embodiment (FIGS. 1 and 2), the angular bend is fixed.

Figure 3:
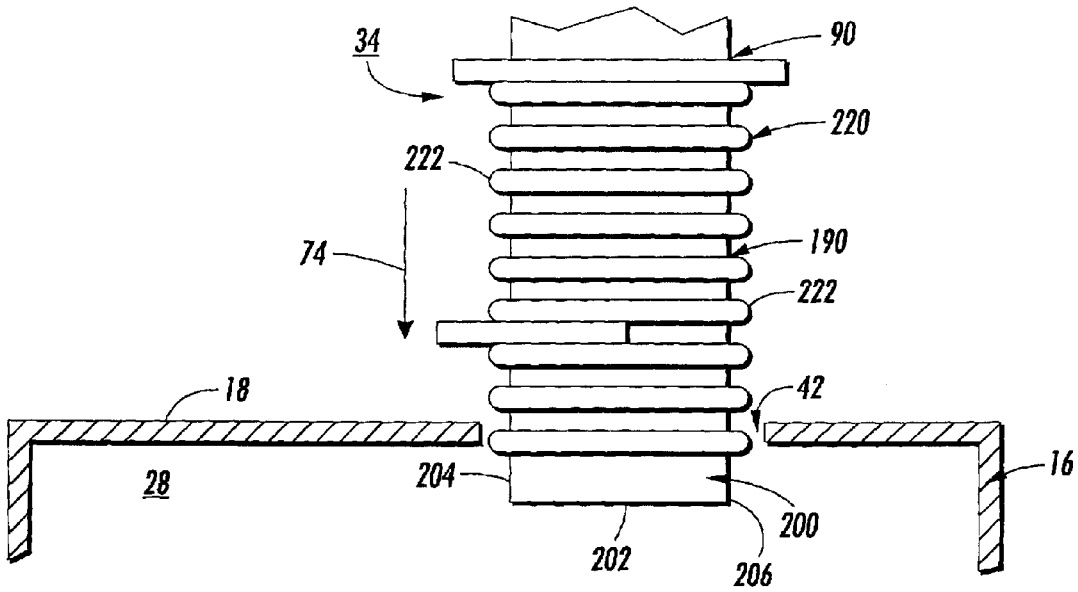
FIG. 3 is an elevational view of the first example of a container showing a second embodiment of the even-filling shaped nozzle of the present invention about to be used.
Figure 4:
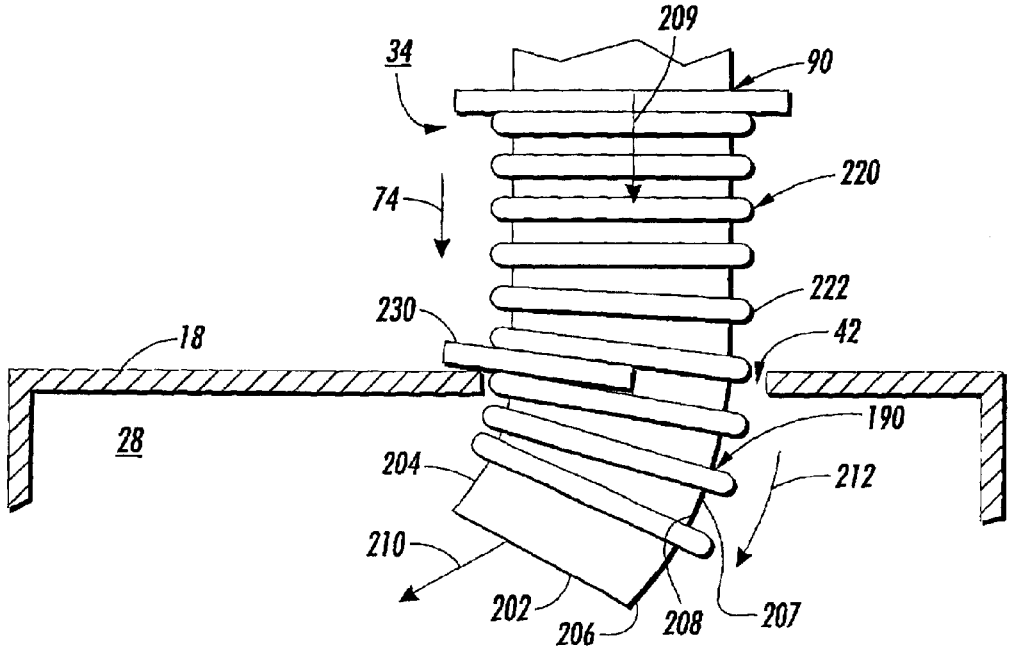
FIG. 4 is the same as FIG. 3, showing the second embodiment of the even-filling shaped nozzle of the present invention being used.

Referring now to FIGS. 3 and 4, the second embodiment is illustrated just about to be used (FIG. 3), and being used (FIG. 4). As shown, in this embodiment of the even-filling nozzle 34, at least the central portion 190 (or the entire nozzle 34) is stretchable, and the enclosed powder redirecting means 207 comprises a resilient and bendable assembly such as a coil spring assembly 220 that is attached externally to the nozzle member 34. The coil spring assembly 220 is comprised of a series of spring coils 222 that ordinarily hold the nozzle in an upright position but can be flexed to bend the nozzle (see arrow 212) to either side to from the angle 208 for example. As such, the entire nozzle is movable and/or rotatable such that the angle 208 can be achieved in order to change the direction of toner flow from 209 to 210.

The even-filling nozzle 34 can be changed as such before or after inserting into the container. The nozzle position may be changed by, for example, mechanical means such as an up, down and rotatably locatable stop member 230 for partially restricting extension of coils 222 of the resilient coil spring assembly 220 so as to induce a variable angular bend (208) in the stretchable central portion 190. The stop member 230 can be moved up and down for positioning between adjacent coils 222 to adjust a length of the nozzle tip inside the container 16. It can also be rotated between such coils from one side to the other depending on the direction of the deeper fill volume 28 of the container 16. As such, the movable nozzle would be able to direct the toner flow to areas of the container where, because of the toner density, the toner does not readily flow.

Figure 5:
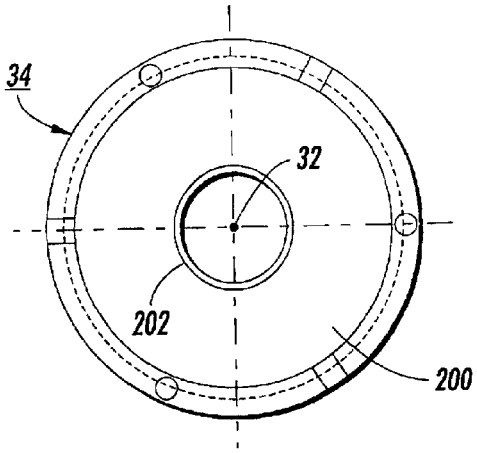
FIGS. 5–7 are each a bottom view of the discharge end of various embodiments of the even-filling shaped nozzle of the present invention.
Figure 6:
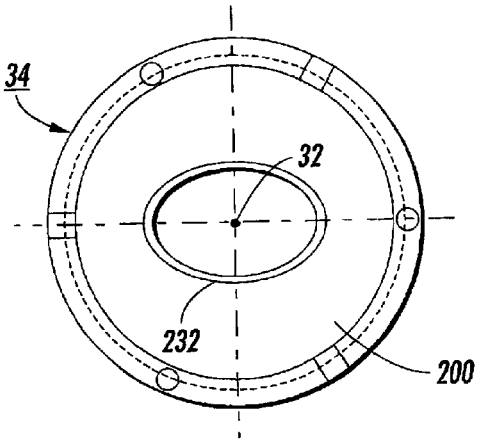
Figure 7:
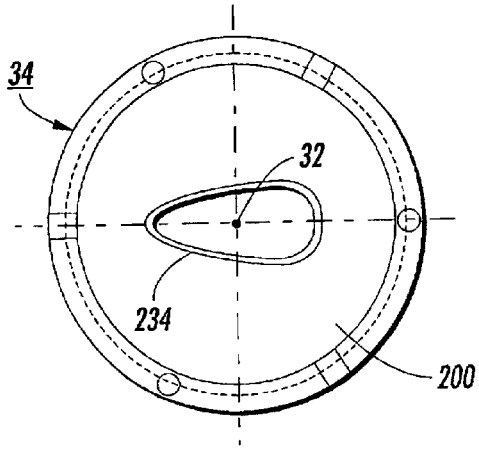

As shown in FIGS. 5–7, the enclosed powder redirecting means 207 (for changing the powder moving direction) may simply comprise a noncircular powder redirecting discharge opening 232, 234. As shown, the noncircular powder redirecting discharge opening can be elliptical 232, as shown in FIG. 6, or it can be pear-shaped 234, as shown in FIG. 7. Alternatively, it can be an irregular cross section to more evenly disperse the toner in a container that has internal features that would need to be avoided or are impeding toner movement. As in the case of the symmetric nozzle with a circular cross section (FIG. 5), nozzles of these other shapes would be molded of porous material.

As can be seen, there has been provided an apparatus for directing toner from a hopper containing a supply of toner to evenly fill a non-symmetric container without excessive dusting and spills. The apparatus includes (a) a conduit member operably connected to the hopper and having a discharging end for permitting a toner to be moved therethrough; (b) a conveyor device located at least partially within the conduit member for moving the toner from the hopper in a toner moving direction towards the non-symmetric container; and (c) a nozzle member for directing the toner from the conveyor to evenly fill the non-symmetric container. The nozzle member is operably connected to the discharge end of the conduit member and has a first end connected to the conduit member, a second and opposite end for dispensing moving toner into the non-symmetric container, and a central portion between the first end and the second and opposite end. The second and opposite end includes an enclosed toner redirecting structure for changing the toner moving direction so as to enable even-filling of the non-symmetric container without excessive dusting and spills.

We claim:

1. An apparatus for directing powder from a hopper containing a supply of powder to evenly fill a non-symmetric container without excessive dusting and spills, the apparatus comprising:

(a) a conduit member operably connected to the hopper and having a discharging end for permitting a powder to be moved therethrough;

(b) a conveyor device located at least partially within said conduit member for moving the powder from the hopper in a powder moving direction towards the non-symmetric container; and (c) a nozzle member for directing the powder from said conveyor to evenly fill the non-symmetric container, said nozzle member being operably connected to said discharge end of said conduit member and having a first end connected to said conduit member, a second and opposite end for dispensing moving powder into the non-symmetric container, and a central portion between said first end and said second and opposite end, said second and opposite end including an enclosed powder redirecting means for changing the powder moving direction so as to enable even-filling of the non-symmetric container without excessive dusting and spills, wherein at least said central portion is stretchable and said enclosed powder redirecting means for changing the powder moving direction comprises a resilient and bendable assembly attached externally to said nozzle member.

2. The apparatus of claim 1, wherein said enclosed powder redirecting means for changing the powder moving direction comprises an angular bend within said central portion.

3. The apparatus of claim 2, wherein said angular bend is fixed.

4. The apparatus of claim 1, wherein said enclosed powder redirecting means for changing the powder moving direction comprises a non-circular powder redirecting discharge opening.

5. The apparatus of claim 4, wherein said non-circular powder redirecting discharge opening is elliptical.

6. The apparatus, of claim 4, wherein said non-circular powder redirecting discharge opening is pear-shaped.

7. The apparatus of claim 1, including an up, down and rotatably locatable stop member for partially restricting extension of coils of said resilient coil spring assembly for inducing a variable angular bend in said stretchable central portion.

* * * * *